US007686948B2

(12) United States Patent
Malek et al.

(10) Patent No.: US 7,686,948 B2
(45) Date of Patent: Mar. 30, 2010

(54) METHOD OF REMOVING SULFUR FROM SULFUR-CONTAINING HYDROCARBON STREAMS

(75) Inventors: Andrzej Malek, Baton Rouge, LA (US); Ramesh Gupta, Berkeley Heights, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 1100 days.

(21) Appl. No.: 11/286,583

(22) Filed: Nov. 23, 2005

(65) Prior Publication Data

US 2006/0138029 A1 Jun. 29, 2006

Related U.S. Application Data

(60) Provisional application No. 60/639,265, filed on Dec. 27, 2004.

(51) Int. Cl.
*C10G 29/04* (2006.01)

(52) U.S. Cl. ..... 208/208 M; 208/208 R; 208/209; 208/213; 208/226

(58) Field of Classification Search ..... 208/208 M, 208/208 R, 209, 213, 226
See application file for complete search history.

(56) References Cited

U.S. PATENT DOCUMENTS 2,078,468 A * 4/1937 Stratford ..... 208/230
3,791,966 A 2/1974 Bearden, Jr. et al. .... 208/208 M
3,976,559 A 8/1976 Bearden, Jr. et al. ..... 208/89
5,674,378 A * 10/1997 Kraemer et al. ..... 208/233
6,210,564 B1 4/2001 Brons et al. ..... 208/208 M

OTHER PUBLICATIONS

Sarbak, Z (1997). Applied Catalysis A: General, 159, 147-157.*

Vanderbilt, B.M.: "Desulfurization and Refining of Naphthas by Metallic Sodium," Industrial and Engineering Chemistry, vol. 49, No. 4, 1957, pp. 696-703. Usamerican Chemicl Society, XP-002357858.

Gerlock, J.L.: "Reaction of Thiophene with Sodium on Alumina. A Method for Desulfurization of Volatile Fuels," Industrial and Engineering Chemistry Fundamentals, vol. 17, No. 1, 1978, pp. 23-28. Usamerican Chemical Society, Washington, DC, XP-002357859.

* cited by examiner

*Primary Examiner*—Robert J Hill, Jr.
*Assistant Examiner*—Brian McCaig

(57) ABSTRACT

The use of one or more alkali metals, preferably sodium, to remove sulfur from hydrocarbon streams containing up to about 100 wppm sulfur. The hydrocarbon stream is introduced into a reactor where it is contacted with one or more alkali metals. The treated hydrocarbon stream is then subjected to a water wash thereby resulting in an aqueous phase fraction and a hydrocarbon phase fraction. The aqueous phase fraction, which is separated from the hydrocarbon phase fraction contains water-soluble sodium moieties.

10 Claims, 1 Drawing Sheet

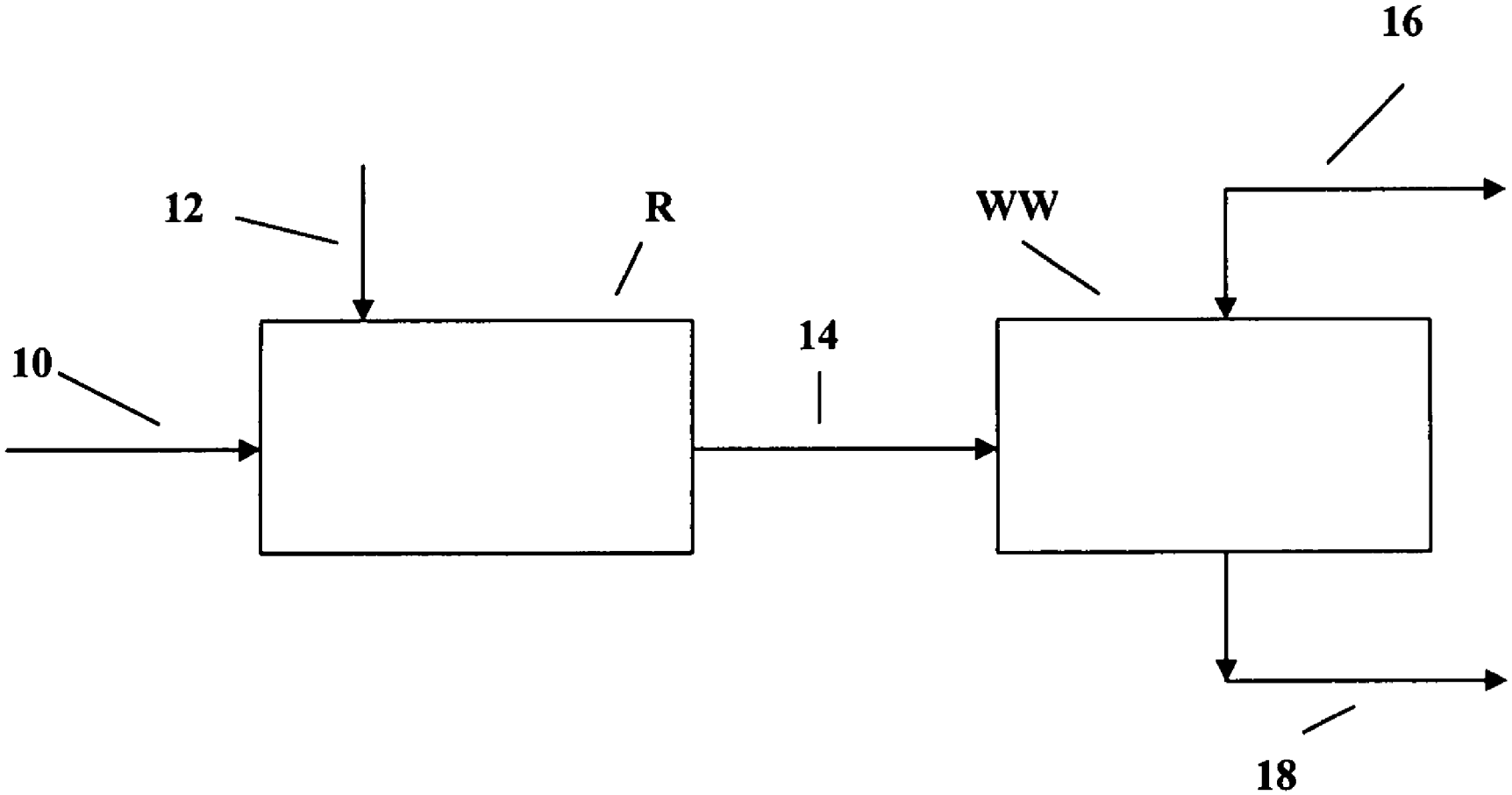
16
WW
R
12
10
14
18

METHOD OF REMOVING SULFUR FROM SULFUR-CONTAINING HYDROCARBON STREAMS

CROSS REFERENCE TO RELATED APPLICATION

This application claims benefit of U.S. Provisional Patent Application No. 60/639,265 filed on Dec. 27, 2004.

FIELD OF THE INVENTION

This invention relates to the use of one or more alkali metals, preferably sodium, to remove sulfur from hydrocarbon streams containing up to about 100 wppm sulfur. The hydrocarbon stream is introduced into a reactor where it is contacted with one or more alkali metals. The treated hydrocarbon stream is then subjected to a water wash thereby resulting in an aqueous phase fraction and a hydrocarbon phase fraction. The aqueous phase fraction, which is separated from the hydrocarbon phase fraction contains water-soluble sodium moieties.

BACKGROUND OF THE INVENTION

Increasingly stringent specifications on motor fuel sulfur levels pose a refining and distribution challenge. In the future, these specifications are expected to tighten further with some fuels ultimately being required to have near-zero wppm sulfur levels. Current refinery hydroprocessing technology is not economical for meeting such near-zero ppm sulfur specifications. Thus, new desulfurization technology is needed to more economically reach those levels. Sodium has long been recognized as a desulfurizing agent for hydrocarbon materials, but safety concerns, among others, have prevented the development of a commercial sodium-based desulfurization process.

Legislation in recent years in many countries around the world requires that diesel and gasoline sulfur levels be typically less than 10's of wppm. It is likely that clean fuels with about 10 wppm or less sulfur will be legislated in most parts of the world.

In addition to ultra-clean mogas and diesel regulations, new technological developments are anticipated to create needs for liquid hydrocarbon fuels with less than 1 wppm sulfur. Currently, significant research and development effort is underway to develop fuel-cell powered automobiles. It is anticipated that these fuel-cell powered vehicles will begin to replace conventional internal combustion and diesel engines within the next several decades. Such fuel-cell vehicles may deploy an onboard catalytic reformer to generate hydrogen from gasoline. The fuel cells and various catalyst systems required to produce hydrogen are very susceptible to poisoning by sulfur and will require hydrocarbon fuels with less than about 1 wppm sulfur.

Traditionally, refineries use hydroprocessing to lower sulfur levels in hydrocarbon streams. While commercially attractive and widely used to meet sulfur specifications, hydroprocessing is not commercially viable for meeting the very stringent sulfur specifications of the future. For example, complete removal of the refractory sulfur species, such as substituted dibenzothiophenes, from distillate feedstreams requires severe hydroprocessing conditions that are economically unattractive. To achieve very low levels of sulfur in distillate products, such as diesel fuels, significant new investment in high-pressure hydroprocessing and new hydrogen facilities would be needed. Additionally, the octane loss associated with severe hydrotreating of mogas pool feedstreams limits the production of ultra low sulfur fuels by conventional hydroprocessing methods. Even with advanced hydrotreating technologies, there may be a need for an alternative desulfurization technology to allow more flexibility and control in refining operations. Thus, there is need for an alternate desulfurization process that can produce motor fuels containing near-zero sulfur.

SUMMARY OF THE INVENTION

In accordance with the present invention, there is provided a process for removing substantially all sulfur from hydrocarbon streams containing up to about 100 wppm sulfur, which process comprises:

a) treating a hydrocarbon stream containing up to about 100 wppm sulfur with an effective amount of one or more alkali metals, wherein said one or more alkali metals reacts with at least a portion of the sulfur in the hydrocarbon stream;

b) conducting the treated hydrocarbon stream to a wash zone wherein it is contacted with an effective amount of water thereby resulting in an aqueous fraction containing water-soluble alkali metal components and a hydrocarbon fraction that is substantially free of sulfur; and c) separating said aqueous phase fraction from said hydrocarbon phase fraction.

In a preferred embodiment, the hydrocarbon stream is a sulfur-containing naphtha or distillate stream.

In another preferred embodiment, the alkali metal is sodium or a mixture of sodium with at least one other alkali metal.

In another preferred embodiment, the level of sulfur in the hydrocarbon stream to be treated is from about 10 to about 30 wppm sulfur.

BRIEF DESCRIPTION OF THE FIGURE

The FIGURE hereof is a representation of one preferred process scheme for practicing the present invention.

DETAILED DESCRIPTION OF THE INVENTION

Alkali metals, particularly sodium metal, have long been recognized as desulfurizing agents for organically-bound sulfur. However, the application of sodium treating for trim sulfur removal from motor fuels has not been pursued. By "trim sulfur removal" we mean removing the remaining small amounts of sulfur (≦100 wppm S) from a previously processed hydrocarbon stream. The main focus of sodium treating in the past has been in the area of desulfurization of residuum that typically contains large amounts of sulfur. It has been shown that supported sodium is capable of reacting with even the most hindered, or refractory, sulfur species. While sodium is widely used in several other chemical processes, and is used as a heat transfer medium in high temperature heat exchangers, no commercial scale sodium desulfurization process has been developed for petroleum refining. There are several key concerns that have prevented the development of a sodium-based desulfurization process.

For example, prior focus was on bulk desulfurization from heavy feeds. That is, on feeds containing from about 10,000 to about 30,000 wppm sulfur. Such a process requires large amounts of sodium that must be recovered and recycled. While several different sodium recovery processes were investigated in the past, no effective and economically attractive solution was found. Also, sodium is highly reactive with water and has an auto-ignition temperature of about 125° C. in air. Bulk desulfurization of streams containing high levels of sulfur would require large quantities of sodium deployed in large reactors. These large amounts of sodium raise significant safety concerns. For example, a process upset resulting in a water slug could cause a run-away reaction resulting in serious safety concerns. Such safety concerns are alleviated if reactors with very low sodium inventory are used. Contrary to the past focus on bulk desulfurization of heavy feeds, the current need for ultra-clean fuel products provides a new opportunity to deploy sodium for desulfurization. The quantities of sodium needed for the desulfurization process of the present invention are 2 to 3 orders of magnitude less than that required for desulfurizing heavy feeds. This low level of sodium eliminates the need for sodium recovery and recycle. The instant desulfurization process is suitable for feeds containing greater than 0 and up to about 100 wppm sulfur, preferably on feeds containing from about 10 to about 100 wppm, more preferably on feeds containing from about 10 to about 70 wppm sulfur, most preferably on feeds containing from about 10 to about 50 wppm sulfur, particularly on feeds containing from about 10 to about 30 wppm sulfur.

The present invention can be practiced in accordance with one preferred embodiment represented in the sole FIGURE hereof. A hydrocarbon feedstock, preferably a naphtha or distillate boiling range feedstock, is conducted to reaction zone R via line 10. The reaction zone can comprise any suitable one or more reactor vessels. Non-limiting examples of suitable reactors that can be used in the practice of the present invention include fixed bed reactors, stirred bed reactors, and pipe reactors containing effective mixing means, such as orifice mixing plates. Fixed bed reactors containing an effective amount of a suitable packing material is a preferred reactor because it will retain the injected sodium for a longer period of time, thus reducing the total amount of sodium required for the process. This is because the retained sodium will continue to react until depleted, thus the required stoichiometric excess of sodium will be reduced. The temperature at which the reaction zone will be operated will be at least the melting temperature of sodium. Preferred temperatures will range from about 100° C. to about 600° C., preferably from about 100° C. to about 400° C. The reaction zone will be operated at a high enough pressure to keep the reactants in the liquid phase, preferably the pressure will not exceed about 500 psig (3,549 kPa) and typically less than about 300 psig (2,170 kPa).

Sodium is conducted, preferably by injection, to reaction zone R via line 12 in an effective amount. By "effective amount" we mean that amount needed to react with substantially all of the sulfur moieties in the feed. The effective amount will typically range from about 1 to about 10 mols of sodium per mol of sulfur in the feed being desulfurized. The rate of sodium addition is a function of such things as sulfur concentration and feed processing rate and is controlled to accomplish the desired reactions with minimum sodium expenditure. This also minimizes total inventory of active sodium in the system at any given moment. For example, the rate of sodium injected will be in the range of about 2 to about 20 cc/second for processing a 30,000 barrel of hydrocarbon feed containing about 50 wppm sulfur. The sodium will be in an injectable form that can be injected directly into the reaction zone, or into the feed to be treated prior to the feed being injected into the reaction zone, or both. Any suitable injection means can be used to inject the sodium, including, but not limited to, spray nozzles and mixing valves. Also, injectable sodium can be sodium in liquid form as well as in vapor form, although liquid form is preferred. In such an approach, a fine particulate of sodium is generated and mixed with the feed, thus allowing the desired reaction to take place. It is within the scope of this invention that sodium can be used in the system on a support. Non-limited examples of supports include alumina, silica, alumina-silica, sodium carbonate and the like. In such an approach, sodium can be delivered as a powder with sodium impregnated on them or as a pre-mixed slurry of such solids in a hydrocarbon carrier. Various suitable sodium derivatives can also be used, such as sodium alloys. Sodium as liquid (melting point 98° C.) would likely be the preferred form for injection.

It is preferred that hydrogen also be introduced into reaction zone R via a line not shown. Typically, the hydrogen partial pressure in the reaction zone will be less than about 300 psig (2,170 kPa), preferably less than about 200 psig (2,062 kPa). The reaction zone can be a single reaction zone in a single reactor, or it can be multiple zones in a single or multiple reactors.

It is preferred that the hydrocarbon feed be introduced into the reaction zone R as a preheated feed. Such a feed will typically be the product stream from a previous reaction unit in the refinery. At such conditions, the sodium will typically be present as a liquid and the reaction with sodium will take place on the surface of the sodium droplet. Therefore, an effectively small droplet size and sufficient residence time will be required for the reaction to proceed at a desirable rate. At sufficiently high temperatures, sodium vapor will play the same role in the reaction as well. For example, at temperatures of about 300° C. and a pressure of about 200 psig (2,062 kPa) partial pressure the amount of sodium needed will be on the order of about 1% of that required to react with about 30 wppm sulfur. Any unreacted sodium and reaction products, such as $Na_2S$ may be separated and recycled in the process. Recycle may be beneficial for minimizing the cost of sodium. In addition, any recycle sediments can provide additional surface area for sodium to adsorb and stay in the reactor for a longer period of time.

Also, it is preferred that the sodium be injected and dispersed relatively quickly in a single step, although multiple steps can be used. Multiple steps may be preferred in the case where it is desirable to increase sulfur versus olefin reaction selectivity. It may also be preferred to disperse sodium in small amounts of the total hydrocarbon stream or in a solvent and injected into the remaining feed to be treated. The choice of reactor will depend on the desired temperature at which the reaction zone is run. For example, if desulfurization kinetics is sufficiently rapid at the desired temperature, a long residence time is not needed and a relatively simple pipe reactor with a series of mixing orifices or mixing valves can be used. On the other hand, if long residence times are needed, then a reactor designed for long residence times can be used.

The reaction mixture of hydrocarbon feed and injected sodium is conduced via line 14 to water wash zone WW wherein an aqueous phase fraction and a hydrocarbon phase fraction results. It is be understood that the water can be injected directly into the feed mixture being conduced from reaction zone R to water wash zone WW or it can be injected directly into water wash zone WW either before, during, or after introduction of the treated feedstream. It is preferred that it be introduced into the reaction mixture being conducted from the reaction zone R to water wash zone WW. The water will convert at least a portion of the unconverted sodium to sodium hydroxide. The resulting $Na_2S$ and NaOH-laden water phase can then be separated from the hydrocarbon phase fraction and removed via line 18 from the system, preferably with use of suitable device, such as a desalter. The separation will typically be relatively easy given the relatively low viscosities and the relatively large density differences between the two liquids.

Vapor pressure of sodium at elevated temperatures can be used to deliver sodium to the feed. In such an approach, sodium will be heated in a separate reservoir to a temperature required to generate the desired vapor pressure of sodium. A stream of inert gas, such as nitrogen, or a reducing gas, such as hydrogen will be passed through the reservoir at a pressure matched to that of the hydrocarbon feed. Mixing this stream in the desired proportions with the hydrocarbon feed will deliver sodium to the feed vapor phase, as condensate, depending on the partial pressure of sodium and the final feed temperature following mixing. The use of hydrogen rather that nitrogen can be beneficial because it may aid in capping radicals generated in the reaction of sodium with sulfur molecules.

Further, to achieve the desired level of desulfurization, the contact time of sodium and feedstream to be treated may have to be extended beyond the time typically available in the reactor design. This can be accomplished by including a particulate removal monolith or a fixed bed filled with a support, such as silica, alumina, clay or other suitable support. In such an approach, unreacted sodium particles or excess of sodium used in the process would be intercepted on the monolith or within the fixed bed and allow for further desulfurization. This process can continue until a designed pressure drop across the monolith or the fixed bed would develop due to deposition of sodium and sodium byproducts such as $Na_2S$. At this point, the feedstream would be switched to a back-up monolith or fixed bed and the spent one could be regenerated by use of water and drying.

The invention claimed is:

1. A trim sulfur removal process for removing substantially all sulfur from hydrocarbon streams containing up to about 100 wppm sulfur, which process comprises:

a) conducting a hydrocarbon stream containing up to about 100 wppm sulfur into a reaction zone wherein it is contacted with an effective amount of alkali metals including sodium on an inert support that is selected from the group consisting of alumina, silica, alumina-silica, and sodium carbonate, wherein said one or more alkali metals reacts with at least a portion of the sulfur in the hydrocarbon stream;

b) conducting the treated hydrocarbon stream to a wash zone wherein it is contacted with an effective amount of water thereby resulting in an aqueous fraction containing water-soluble alkali metal components and a hydrocarbon fraction containing less than about 1 wppm sulfur; and c) separating said aqueous phase fraction from said hydrocarbon phase fraction.

2. The process of claim 1 wherein the alkali metal is sodium.

3. The process of claim 2 wherein the hydrocarbon stream contains from about 10 to about 50 wppm sulfur.

4. The process of claim 3 wherein the reaction zone is maintained at a temperature from about 100° C. to about 400° C.

5. The process of claim 2 wherein the sodium is introduced into the hydrocarbon stream prior to said hydrocarbon stream being conducted to the reaction zone.

6. The process of claim 2 wherein the sodium is introduced into the reaction zone simultaneously with the introduction of the hydrocarbon stream.

7. The process of claim 2 wherein a first portion of the sodium is introduced into the hydrocarbon stream prior to the hydrocarbon steam being introduced into said reaction zone and a second portion of sodium is introduced into the reaction zone simultaneously with the introduction of the hydrocarbon stream.

8. The process of claim 1 wherein the hydrocarbon stream contains from about 10 to about 70 wppm sulfur.

9. The process of claim 1 wherein the reaction zone is maintained at a temperature from about 100° C. to about 400° C.

10. The process of claim 1 wherein at least a portion or any product sulfur-containing components are separated and recycled to said reaction zone.

* * * * *